US011207551B2

(12) United States Patent
Pechacek

(10) Patent No.: US 11,207,551 B2
(45) Date of Patent: Dec. 28, 2021

(54) DRY SPRINKLER ASSEMBLY

(71) Applicant: Victaulic Company, Easton, PA (US)

(72) Inventor: Stephen Pechacek, Danielsville, PA (US)

(73) Assignee: Victaulic Company, Easton, PA (US)

( * ) Notice: Subject to any disclaimer, the term of this patent is extended or adjusted under 35 U.S.C. 154(b) by 194 days.

(21) Appl. No.: 16/547,890

(22) Filed: Aug. 22, 2019

(65) Prior Publication Data

US 2020/0061401 A1 Feb. 27, 2020

Related U.S. Application Data

(60) Provisional application No. 62/721,753, filed on Aug. 23, 2018.

(51) Int. Cl.

| | |
|---|---|
| ***A62C 3/00*** | (2006.01) |
| ***A62C 37/11*** | (2006.01) |
| ***A62C 35/62*** | (2006.01) |
| ***A62C 37/14*** | (2006.01) |

(52) U.S. Cl.

CPC ..... *A62C 3/004* (2013.01); *A62C 37/11* (2013.01); *A62C 35/62* (2013.01); *A62C 37/14* (2013.01)

(58) Field of Classification Search

CPC ..... A62C 3/002; A62C 3/004; A62C 35/62; A62C 37/08; A62C 37/09; A62C 37/10; A62C 37/11; A62C 37/12; A62C 37/14; A62C 37/16

See application file for complete search history.

(56) References Cited

U.S. PATENT DOCUMENTS

| | | | | |
|---|---|---|---|---|
| 1,903,150 | A | 3/1933 | Tyden | |
| 2,155,990 | A * | 4/1939 | Hodgman, Jr. ..... | A62C 37/12 169/39 |
| 2,180,258 | A * | 11/1939 | Rowley ..... | A62C 37/10 169/41 |
| 3,007,528 | A | 11/1961 | Gloeckler | |
| 3,031,212 | A | 4/1962 | Oliver | |
| 3,080,000 | A | 3/1963 | Gloeckler | |
| 3,125,358 | A | 3/1964 | Kleinberg et al. | |
| 3,584,689 | A | 6/1971 | Willms | |
| 4,071,265 | A | 1/1978 | Wallace | |
| 4,165,105 | A | 8/1979 | Hahn | |
| 4,177,862 | A | 12/1979 | Bray | |
| 4,228,858 | A * | 10/1980 | Sclafani ..... | A62C 37/09 137/72 |
| 4,385,777 | A | 5/1983 | Logsdon | |
| 4,417,626 | A | 11/1983 | Hansen | |
| 4,918,761 | A | 4/1990 | Harbeke | |

(Continued)

FOREIGN PATENT DOCUMENTS

| | | |
|---|---|---|
| AU | 2004100686 | 9/2004 |
| BE | 660833 | 7/1965 |

(Continued)

*Primary Examiner* — Darren W Gorman

(74) *Attorney, Agent, or Firm* — Ballard Spahr LLP

(57) ABSTRACT

A dry sprinkler assembly for fire suppression uses a tube within a pipe element to maintain a spring loaded valve in a closed position at the end of the pipe element connected to a piping network. The tube is held against the biasing force of the valve's spring by a plug acted on by the temperature sensitive trigger of the sprinkler mounted on the opposite end of the pipe element.

22 Claims, 10 Drawing Sheets

(56) References Cited

U.S. PATENT DOCUMENTS

| | | | | |
|---|---|---|---|---|
| 5,188,185 | A | 2/1993 | Mears | |
| 5,228,520 | A | 7/1993 | Gottschalk | |
| 5,390,465 | A | 2/1995 | Rajecki | |
| 5,415,239 | A | 5/1995 | Kotter et al. | |
| 5,609,211 | A * | 3/1997 | Meyer | A62C 37/08 169/16 |
| 5,775,431 | A | 7/1998 | Ondracek | |
| 5,967,240 | A | 10/1999 | Ondracek | |
| 6,293,348 | B1 | 9/2001 | Reilly | |
| 6,367,560 | B1 | 4/2002 | de Ris et al. | |
| 6,488,097 | B1 | 12/2002 | MacDonald, III et al. | |
| 6,536,533 | B2 | 3/2003 | Reilly | |
| 6,666,277 | B2 | 12/2003 | Reilly | |
| 6,708,771 | B2 | 3/2004 | Reilly | |
| 6,752,217 | B2 | 6/2004 | Reilly | |
| 6,851,482 | B2 | 2/2005 | Dolan | |
| 7,143,834 | B2 | 12/2006 | Dolan | |
| 7,213,319 | B2 | 5/2007 | Silva, Jr. et al. | |
| 7,373,720 | B1 | 5/2008 | Jensen et al. | |
| 7,383,892 | B2 | 6/2008 | Jackson | |
| 7,389,824 | B2 | 6/2008 | Jackson | |
| 7,516,800 | B1 | 4/2009 | Silva, Jr. et al. | |
| 7,559,376 | B2 | 7/2009 | Silva, Jr. | |
| 7,802,628 | B1 | 9/2010 | Silva, Jr. et al. | |
| 2002/0003042 | A1 | 1/2002 | Reilly | |
| 2002/0050531 | A1 | 5/2002 | Dolan | |
| 2003/0000712 | A1 | 1/2003 | Franson | |
| 2003/0075343 | A1 | 4/2003 | Ballard | |
| 2005/0072580 | A1 | 4/2005 | Jackson | |
| 2005/0121206 | A1 | 6/2005 | Dolan | |
| 2005/0173562 | A1 | 8/2005 | Franson | |
| 2006/0113093 | A1 | 6/2006 | Silva, Jr. | |
| 2006/0113094 | A1 | 6/2006 | Silva, Jr. et al. | |
| 2006/0243459 | A1 | 11/2006 | Jackson | |
| 2007/0169946 | A1 | 7/2007 | Cordell et al. | |
| 2007/0187116 | A1 | 8/2007 | Jackson et al. | |
| 2008/0066932 | A1 | 3/2008 | MacDonald, III et al. | |
| 2008/0257567 | A1 | 10/2008 | MacDonald et al. | |
| 2009/0211772 | A1 | 8/2009 | Silva, Jr. | |
| 2009/0294138 | A1 | 12/2009 | Jackson et al. | |
| 2010/0038099 | A1 | 2/2010 | Thompson et al. | |
| 2011/0215566 | A1 | 9/2011 | Stempo et al. | |
| 2012/0132444 | A1 | 5/2012 | Buzdum et al. | |
| 2014/0096981 | A1 | 4/2014 | Ringer et al. | |
| 2014/0174768 | A1 | 6/2014 | Bucher et al. | |
| 2015/0122513 | A1* | 5/2015 | Miller | B05B 1/265 169/37 |
| 2017/0340911 | A1 | 11/2017 | Meyer et al. | |
| 2018/0353786 | A1 | 12/2018 | Polan | |
| 2019/0240519 | A1* | 8/2019 | Archibald | A62C 37/11 |

FOREIGN PATENT DOCUMENTS

| | | |
|---|---|---|
| CN | 2044882 | 9/1989 |
| CN | 1429127 | 7/2003 |
| CN | 2732281 | 10/2005 |
| DE | 20117370 | 3/2002 |
| GB | 1159606 | 7/1969 |
| GB | 1249113 | 10/1971 |
| JP | S57079555 | 5/1982 |
| JP | S63130076 | 6/1988 |
| JP | 2000153908 | 6/2000 |
| WO | 2006058330 | 6/2006 |

* cited by examiner

FIG.1A
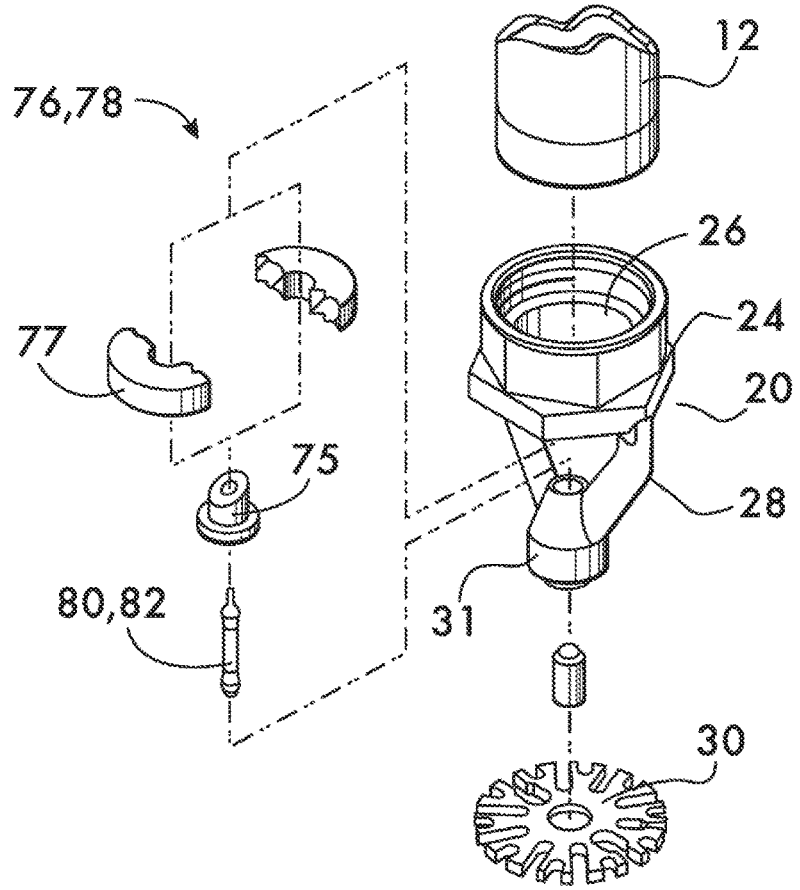
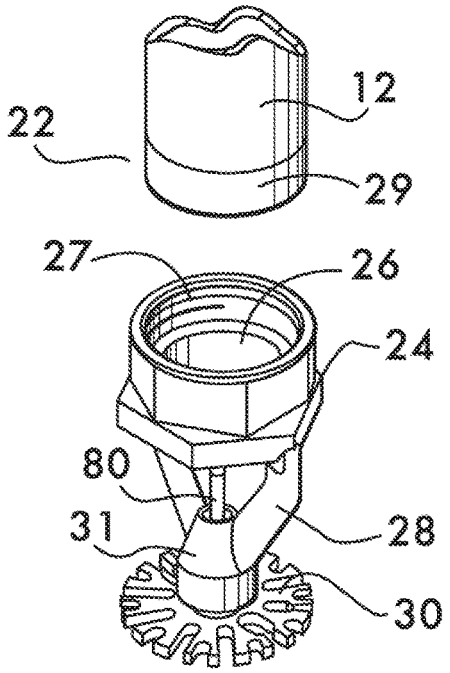
FIG.2A

DRY SPRINKLER ASSEMBLY

CROSS REFERENCE TO RELATED APPLICATIONS

This application is based upon and claims benefit of priority to U.S. Provisional application No. 62/721,753, filed Aug. 23, 2018 and hereby incorporated by reference herein.

FIELD OF THE INVENTION

This invention concerns dry sprinklers for use in sub-freezing ambient conditions.

BACKGROUND

Sprinkler systems for fire suppression are used to protect structures which separate or enclose adjacent regions having large temperature differences from one another. Examples of such structures include freezers, balconies of apartments, and loading docks of warehouses. Each of these structures has one or more walls and/or ceilings, which separate a region wherein the temperature is maintained above the freezing point of water from a region where the temperature is maintained below freezing or can drop below freezing.

It is a challenge to provide fire protection to such structures, especially when water is the preferred fire suppressing liquid because measures must be taken to ensure that the water does not freeze within the piping network. To meet this challenge it is known to position the piping network in the temperature controlled "warm" environment where water within the pipes will not freeze, and to provide "dry" type sprinkler assemblies which extend from the piping network through openings in the ceiling or walls of the structure and into the "cold" or uncontrolled environment. Such dry sprinkler assemblies have elongated pipe elements extending between the sprinkler and the piping network with a valve inside to maintain the sprinkler assembly in a "dry" state, i.e., without water in the pipe element, until the sprinkler is activated by the heat from a fire. A heat sensitive trigger, for example a liquid filled frangible bulb, which breaks when subjected to heat from a fire, opens the sprinkler to permit discharge of the water and also acts to open the valve and allow water to flow from the piping network through the conduit and out through the sprinkler.

It would be advantageous to provide dry sprinkler assemblies which can achieve flow rates having nominal k factors of 11.2 or greater while using, for example, 1 inch NPS pipe for the pipe element comprising the dry sprinkler assembly which connects to the piping network in the warm environment and which has the sprinkler outlet located in the cold environment. (The k factor is defined as $k=q/\sqrt{p}$ where q is the discharge rate from the dry sprinkler assembly in gallons per minute and p is the pressure within the pipe element in psi (gauge)). It would be particularly advantageous to provide dry sprinkler assemblies having nominal k factors equal to or greater than k17 using 1 inch NPS pipe for the pipe element comprising the dry sprinkler. All known commercially available dry sprinklers of k17, such as the Model ESFR-17 Dry Type Pendent Sprinkler sold by Tyco Fire Products, and the K17 Dry ESFR Pendent Storage Sprinkler sold by Viking Group, Inc., comprise pipe elements having a size of greater than 1 inch NPS pipe. Dry sprinklers made of larger pipe sizes weight more, come at greater cost, and are more challenging to install. There is clearly a need to provide dry sprinklers of k factor 11.2 and greater, particularly, k-factor 17, comprising pipe elements of size 1 inch NPS.

SUMMARY

The invention concerns a dry sprinkler assembly for use with a piping network of a fire suppression system. In one example embodiment, the dry sprinkler assembly comprises a 1 inch NPS pipe element having a first end attachable in fluid communication with the piping network. In a practical design it is advantageous that the 1 inch NPS pipe element have a wall thickness less than 0.095 inches. A valve is positioned within the pipe element proximate to the first end. The valve has a first closing member movable between a closed position preventing fluid flow through the pipe element, and an open position permitting fluid flow through the pipe element. A fire suppression sprinkler is mounted on a second end of the pipe element. The sprinkler defines a bore in fluid communication with the pipe element. In an example embodiment the sprinkler comprises a second closing member in engagement with the bore. A temperature sensitive trigger is engaged with the second closing member and maintains the second closing member in engagement with the bore until an ambient temperature exceeds a predetermined threshold. The trigger releases the second closing member from the engagement with the bore when the ambient temperature reaches or exceeds the predetermined threshold thereby permitting fluid flow through the pipe element, wherein when the first closing member is in the open position and the second closing member is released from engagement with the bore, the sprinkler assembly achieves a discharge rate equal to or greater than a k factor of 17.

By way of example, the assembly may further comprise a tube coaxially positioned within the pipe element. The tube has an outer perimeter smaller than an inner perimeter of the pipe element and is moveable lengthwise along the pipe element. The first closing member is mounted on a first end of the tube, a second end of the tube is engaged with the second closing member when the second closing member is in the engagement with the bore.

By way of example, the tube has a round cross section with an outer diameter smaller than an inner diameter of the pipe element. In a further example embodiment, the tube comprises a sidewall defining a plurality of openings therethrough. In an example embodiment, the openings comprise a plurality of slots oriented lengthwise along the tube. In an example embodiment, a portion of the sidewall proximate to the second end of the tube has no openings therethrough. By way of example, the openings may comprise at least 30% of a surface area of the sidewall.

In an example assembly embodiment, the valve comprises a seat mounted proximate to the first end of the pipe element. The first closing member is engageable with the seat. By way of example the first closing member comprises a platform pivotably mounted on the first end of the tube. An obturation body is mounted on the platform. The obturation body is pivotable between a first position facing the seat and engageable therewith, and a second position angularly oriented relative to the seat. In a specific example embodiment the obturation body comprises a Bellville washer.

In an example embodiment a pivot support is mounted on the first end of the tube. The platform is pivotably mounted on the pivot support. A stop surface is positioned on the pivot support. A projection extends from the platform and is engageable with the stop surface to limit pivoting motion of the platform. Further by way of example, a biasing member acts between the tube and the platform for biasing the obturation body into the second position.

In an example embodiment the sprinkler comprises a body defining the bore. A pair of arms extend from the body away from the second end of the pipe element. A deflector plate is mounted on the arms. The trigger is positioned between the deflector plate and the second closing member. The trigger may comprise a frangible vial filled with a heat sensitive liquid.

In an example embodiment the sprinkler comprises at least one stop surface engageable with the tube to limit sliding motion thereof relative to the pipe element. In a specific example, the stop surface comprises at least one projection extending from one of the arms. An example sprinkler may further comprise a nipple extending from the body. The nipple may have male screw threads thereon. In another example embodiment the sprinkler comprises a shoulder on the body. The shoulder projects into the bore and defines the stop surface. In this example embodiment the tube comprises at least one detent projecting outwardly therefrom. The at least one detent is positioned in spaced relation from the second end of the tube and is engageable with the stop surface upon motion of the tube within the pipe element. In a specific example embodiment the shoulder comprises an annulus surrounding the bore. Further by way of example, the body may comprise female threads surrounding the bore. A pair of arms extend from the body away from the second end of the pipe element. In a particular example embodiment the second end of the pipe element has male screw threads thereon engaging the female threads surrounding said bore. A deflector plate is mounted on the arms. The trigger is positioned between the deflector plate and the second closing member.

In a further example embodiment according to the invention, the second closing member comprises a plug. In a specific example, the plug comprises a plurality of plug bodies engageable with the bore. The plug bodies defining a gap permitting draining of condensate from the pipe element. This example embodiment may further comprise a trigger bearing engageable with the plurality of plug bodies and the trigger.

The invention also encompasses a dry sprinkler assembly for use with a piping network of a fire suppression system, the dry sprinkler assembly having a discharge rate equal to or greater than a k factor of 11.2. In an example embodiment the dry sprinkler assembly according to the invention comprises a 1 inch NPS pipe element having a first end attachable in fluid communication with the piping network. In a practical design it is advantageous that the 1 inch NPS pipe element have a wall thickness less than 0.095 inches. A valve is positioned within the pipe element proximate to the first end. The valve has a first closing member movable between a closed position preventing fluid flow through the pipe element, and an open position permitting fluid flow through the pipe element. The valve comprises a seat mounted proximate to the first end of the pipe element. The first closing member is engageable with the seat. A tube is coaxially positioned within the pipe element. The tube has an outer perimeter smaller than an inner perimeter of the pipe element and is moveable lengthwise along the pipe element. The first closing member is mounted on a first end of the tube. By way of example the first closing member comprises a pivot support mounted on the first end of the tube. A platform is pivotably mounted on the pivot support. An obturation body is mounted on the platform. The obturation body is pivotable between a first position facing the seat and engageable therewith, and a second position angularly oriented relative to the seat. A stop surface is positioned on the pivot support. A projection extends from the platform and is engageable with the stop surface to limit pivoting motion of the platform. A fire suppression sprinkler is mounted on a second end of the pipe element. The sprinkler defines a bore in fluid communication with the pipe element. By way of example the sprinkler further comprises a second closing member in engagement with the bore. A second end of the tube is engaged with the second closing member when the second closing member is in engagement with the bore. A temperature sensitive trigger is engaged with the second closing member and maintains the second closing member in engagement until an ambient temperature exceeds a predetermined threshold. The trigger releases the second closing member from the engagement with the bore when the ambient temperature reaches or exceeds the predetermined threshold. When the first closing member is in the open position and the second closing member is released from the engagement, the sprinkler assembly achieves a discharge rate equal to or greater than a k factor of 11.2.

BRIEF DESCRIPTION OF THE DRAWINGS

FIG. 1A is an isometric exploded view of an example component of a dry sprinkler assembly according to the invention;

FIG. 2A is an isometric exploded view of an example component of a dry sprinkler assembly according to the invention;

DETAILED DESCRIPTION

Figure 1:
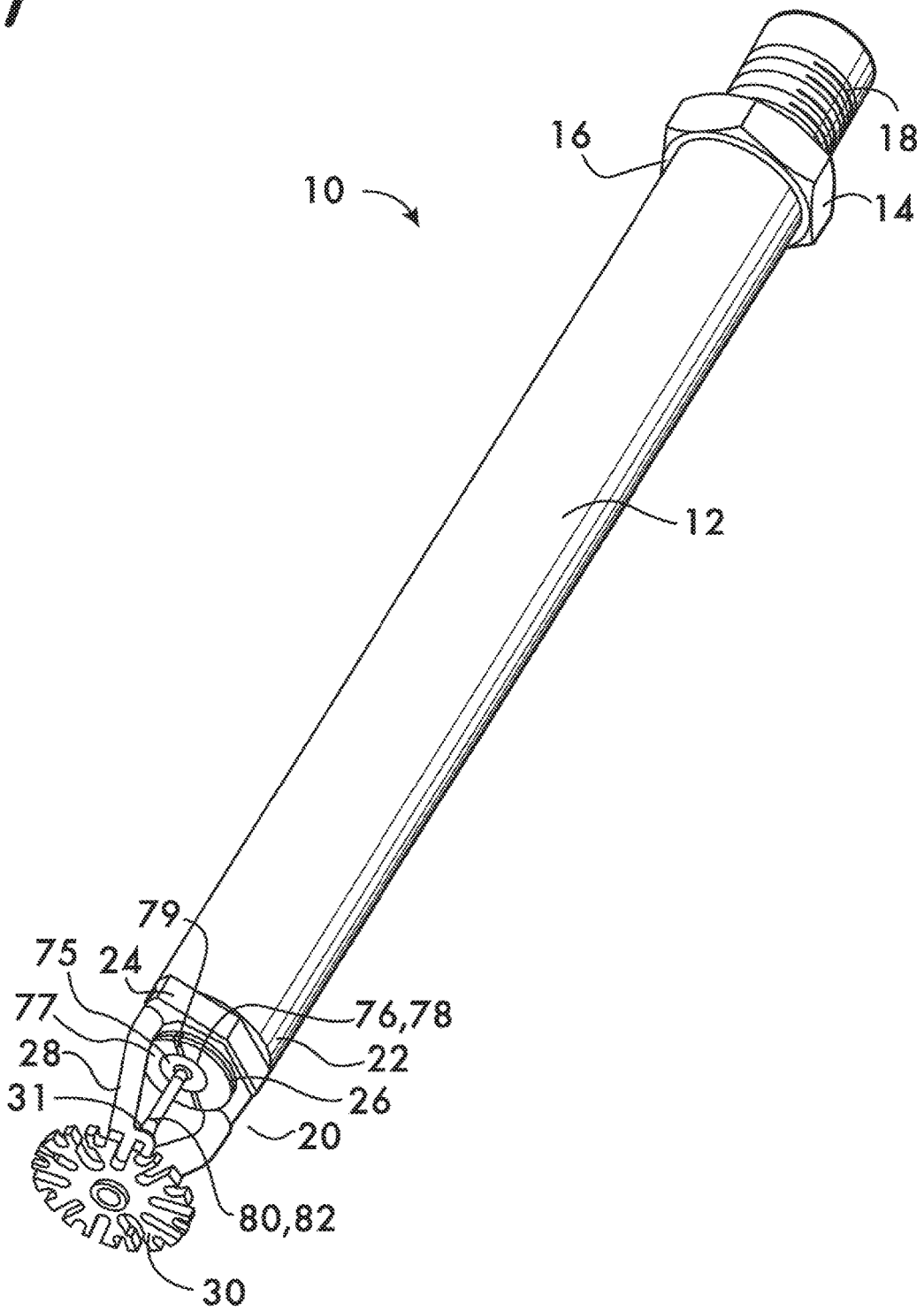
FIG. 1 is an isometric view of an example embodiment of a dry sprinkler assembly according to the invention in a "loaded" state.
Figure 2:
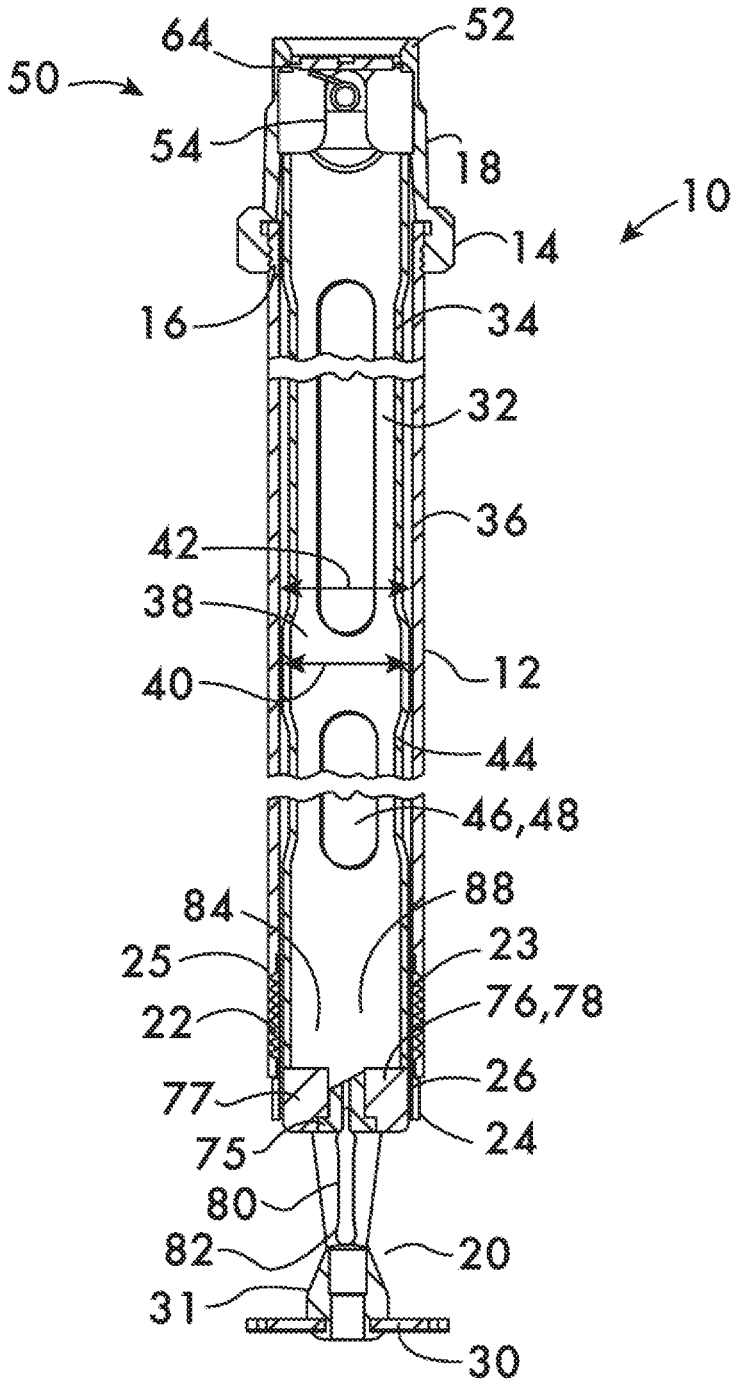
FIG. 2 is a longitudinal sectional view of the dry sprinkler assembly shown in FIG. 1.

FIG. 1 shows an example embodiment of a dry sprinkler assembly 10 according to the invention. Sprinkler assembly 10 comprises a 1 inch National Pipe Standard (NPS) pipe element 12 for use with a piping network of a fire suppression system (not shown). Consistent with the National Pipe Standard, pipe element 12 has a basic outer diameter of 1.315 inches and a wall thickness ranging from 0.0568 inches to 0.133 inches consistent with the wall thicknesses and tolerances for schedule 5, 10 s/20, 30 and 40 s/40 which are feasible for a practical design. To achieve desired flow rates through the pipe element 12 it is advantageous that the wall thickness be less than 0.095 inches. The pipe element 12 may also have a length from about 12 inches to about 36 inches in an assembly according to the invention. A fitting 14 is mounted on a first end 16 of pipe element 12, the fitting having a threaded nipple 18 for attaching the assembly in fluid communication with the piping network. A fire suppression sprinkler 20 is mounted on a second end 22 of the pipe element 12. Sprinkler 20 comprises a body 24 defining a bore 26 (see also FIG. 2A) in fluid communication with the pipe element 12. As shown in FIG. 2, mounting of the sprinkler 20 to pipe element 12 is effected via a male threaded nipple 23 extending from body 24 and engaging compatible female threads 25 on the inside surface of the pipe element 12. In an alternate embodiment, shown in FIG. 2A, sprinkler body 24 comprises female threads 27 within bore 26 which receives pipe element 12 having male threads 29 at its second end 22. Using a pipe element 12 with male threads 29 to engage female threads 27 of a sprinkler body 24 is advantageous because it permits the pipe element's wall to be thinner than if the pipe element has female threads, thereby allowing potentially a greater flow rate through the pipe element by maximizing the inner diameter. In both embodiments (FIGS. 2 and 2A), a pair of arms 28 extend from body 24, the arms supporting a deflector plate 30 mounted thereon.

As shown in FIG. 2, a tube 32 is substantially coaxially positioned within pipe element 12. Tube 32 has a smaller outer perimeter 34 than the inner perimeter 36 of pipe element 12, and is movable lengthwise along the pipe element. In this example embodiment the tube 32 has a round cross section 38 with an outer diameter 40 smaller than an inner diameter 42 of pipe element 12. Tube 32 comprises a sidewall 44 which defines a plurality of openings 46, in this example, slots 48 oriented lengthwise along the tube. Openings 46 may comprise at least 30% of the surface area of the sidewall 44 to permit maximum flow through the pipe element 12 by using as much of the full inner diameter of the pipe element as is practical.

Figure 3:
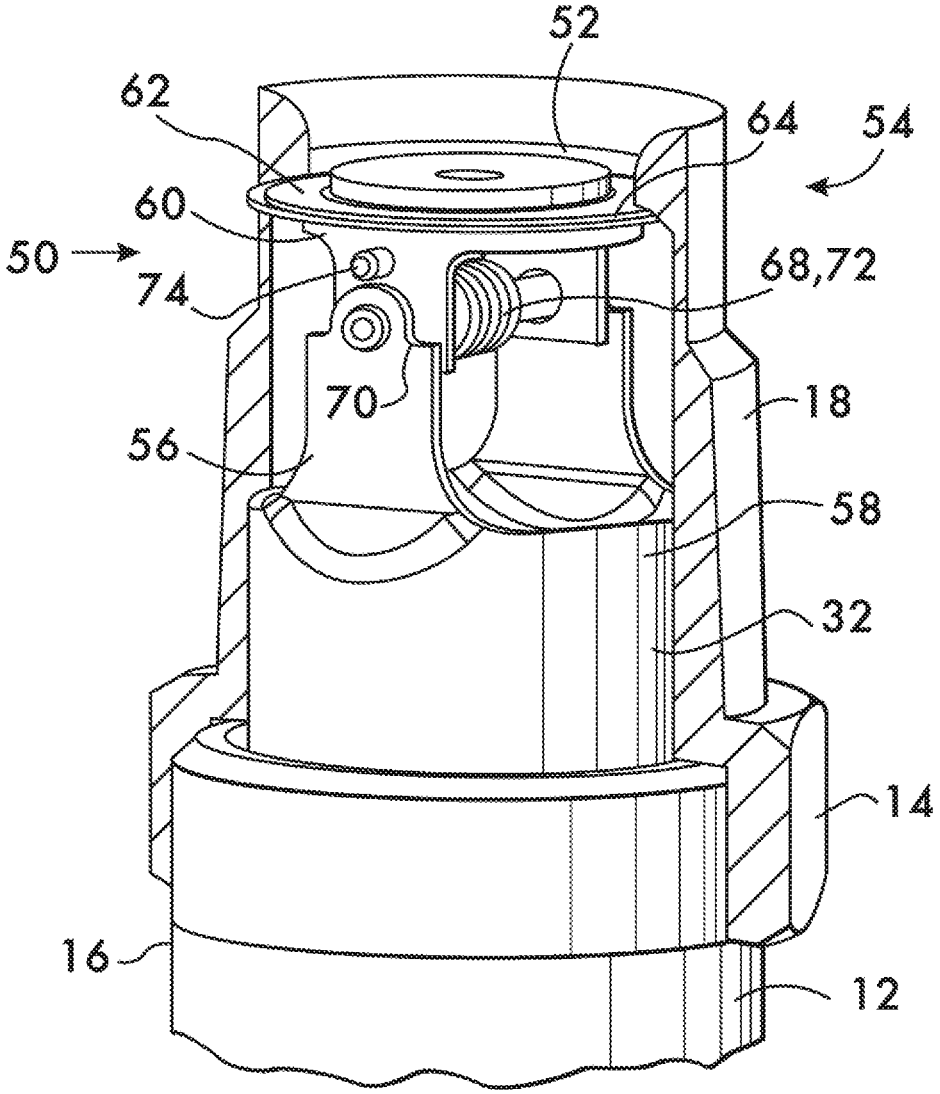
FIGS. 3 and 4 are partial isometric sectional views of a portion of the dry sprinkler assembly shown in FIG. 1.
Figure 4:
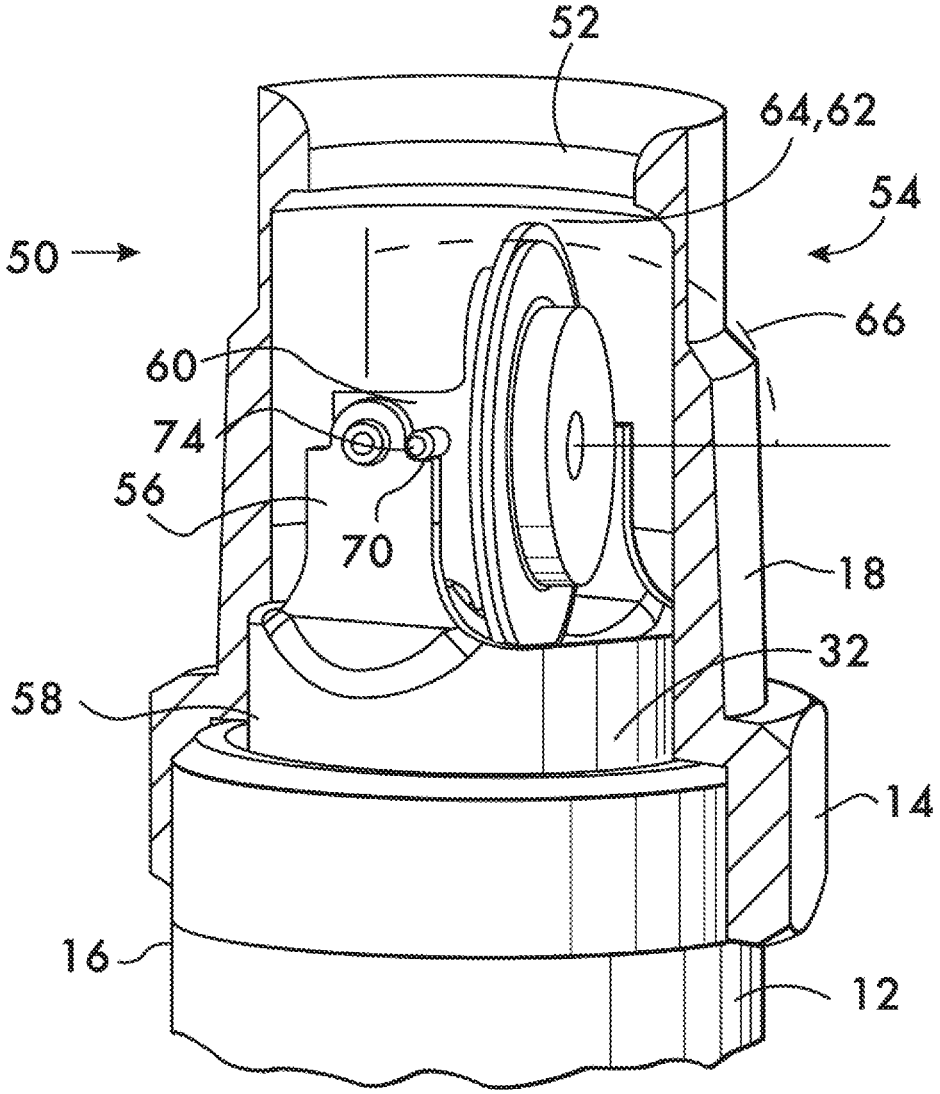
Figure 5:
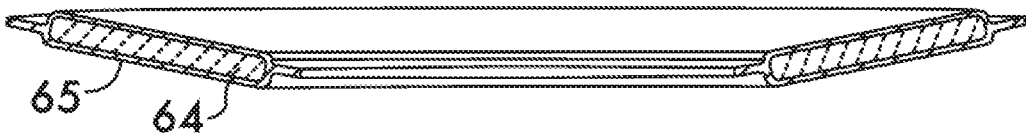
FIG. 5 is a sectional view of a component of the dry sprinkler assembly shown in FIG. 1.

A valve 50 is positioned within pipe element 12 proximate to the first end 16. In the example embodiment shown in FIG. 3, valve 50 comprises a seat 52 integrally formed with fitting 14 and mounted on the first end 16 of the pipe element. Valve 50 further comprises a first closing member 54 engageable with seat 52. In the example valve shown, the first closing member 54 comprises a pivot support 56 mounted on a first end 58 of tube 32. A platform 60 is pivotably mounted on the pivot support 56. An obturation body 62 is mounted on platform 60. In this example embodiment the obturation body 62 comprises a Bellville washer 64 (see also FIG. 5) which is wrapped with a layer of conformal material 65, for example polytetrafluoroethylene, to ensure a fluid tight seal when the washer 64 engages the seat 52. The Bellville washer 64 acts as a spring when the assembly 10 is triggered, as described below. The obturation body 62 (washer 64) is pivotable via platform 60 between a first position facing the valve seat 52 (FIG. 3), and a second position angularly oriented relatively to the seat (FIG. 4). The orientation angle 66 of the body 62 is selected to provide the least head loss (lowest resistance) to fluid flow through the pipe element 12. In this example the orientation angle 66 of the washer 64 is 90°, the angle being established by a combination of a biasing member 68 (see FIG. 3) and a stop surface 70 positioned, in this embodiment, on the pivot support 56. Biasing member 68, in this example, a torsion spring 72, acts between pivot support 56 and platform 60 to bias the platform into the second, angularly oriented position. A projection 74 extending from the platform 60 engages the stop surface 70 to limit rotation of the platform to the desired orientation angle 66. Alternatively (not shown), the projection could be located on pivot support 56 or the first end 58 of tube 32, to engage with a stop surface located on platform 60. Biasing member 68 is designed to have sufficient stiffness to substantially maintain the platform's orientation in spite of turbulent fluid flow through the pipe element 12.

As shown in FIGS. 1, 1A and 2, a second closing member 76 is in engagement with bore 26 defined by the sprinkler body 24. In this example embodiment the second closing member 76 comprises a split plug 78. Split plug 78 comprises three components, the trigger bearing 75 and the plug bodies 77, positioned in spaced relation surrounding the trigger bearing. The trigger bearing 75 straddles a gap 79 defined by the plug bodies 77 when installed within bore 26, the gap allowing condensate to drain from the pipe element 12. Split plug 78 is maintained in engagement with bore 26 by a temperature sensitive trigger 80 acting between the trigger bearing 75 and a nose 31 supported by the arms 28. In the example shown, the trigger 80 comprises a frangible vial 82 containing a heat sensitive liquid. Another well-known trigger comprises a mechanical linkage held together by a eutectic solder.

As shown in FIG. 2, the second closing member 76 maintains the first closing member 54 engaged with the seat 52 by engaging and supporting the second end 84 of tube 32, thereby preventing flow through, or leakage into, the pipe element 12. The tube 32 has a length such that, when it is engaged and supported by the second closing member 76, the first closing member 54 sealingly engages the seat 52 to prevent flow through the pipe element 12. When the first closing member 54 comprises a Belleville washer 64 as shown in FIGS. 2 and 3, the washer is compressed against the seat 52 and acts as a preloaded spring to move the tube 32 lengthwise through the pipe element 12 and toward its second end 22 when the second closing member 76 is released from engagement with the sprinkler bore 26 as described below. The stiffness of biasing member 68, may also act to move tube 32 toward second end 22.

Figure 6:
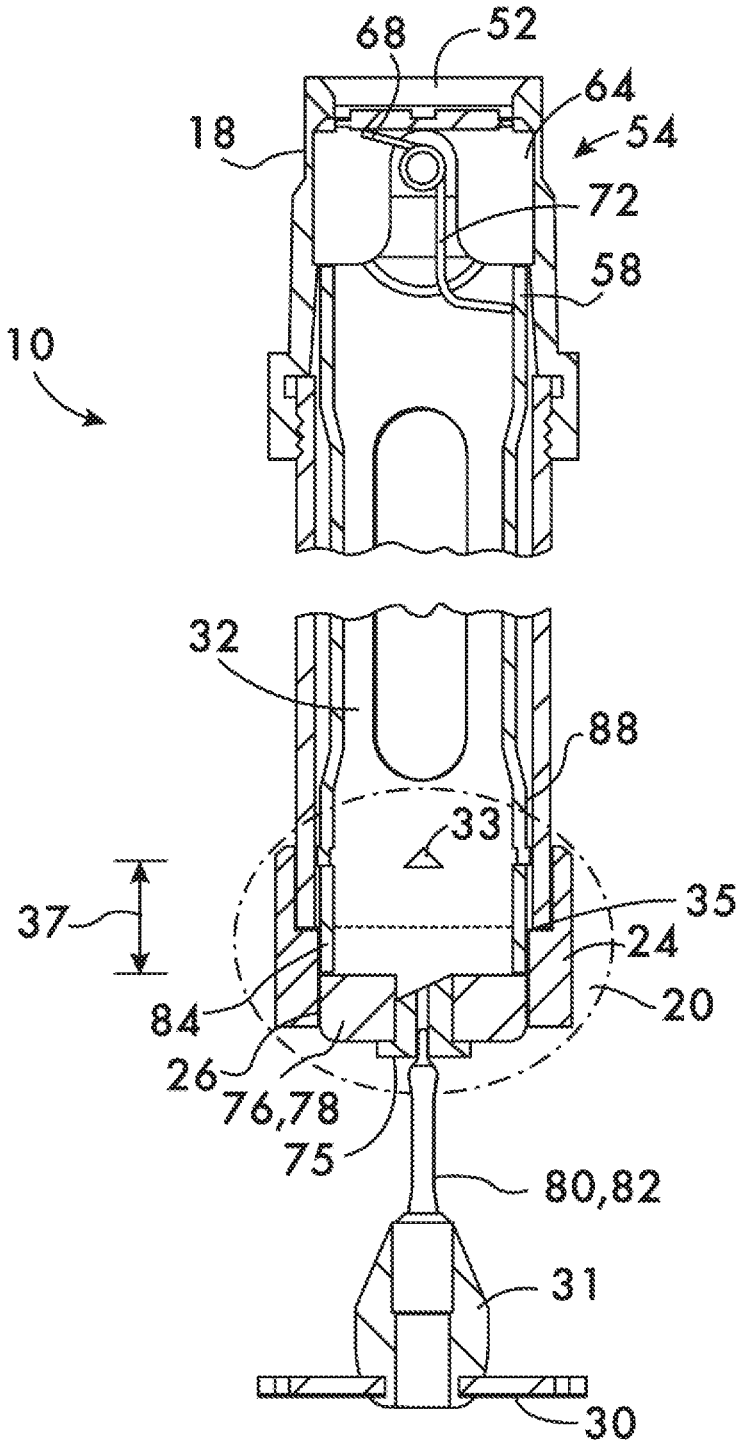
FIG. 6 is a longitudinal sectional view of the dry sprinkler assembly shown in FIG. 1 in a "loaded" state.
Figure 6A:
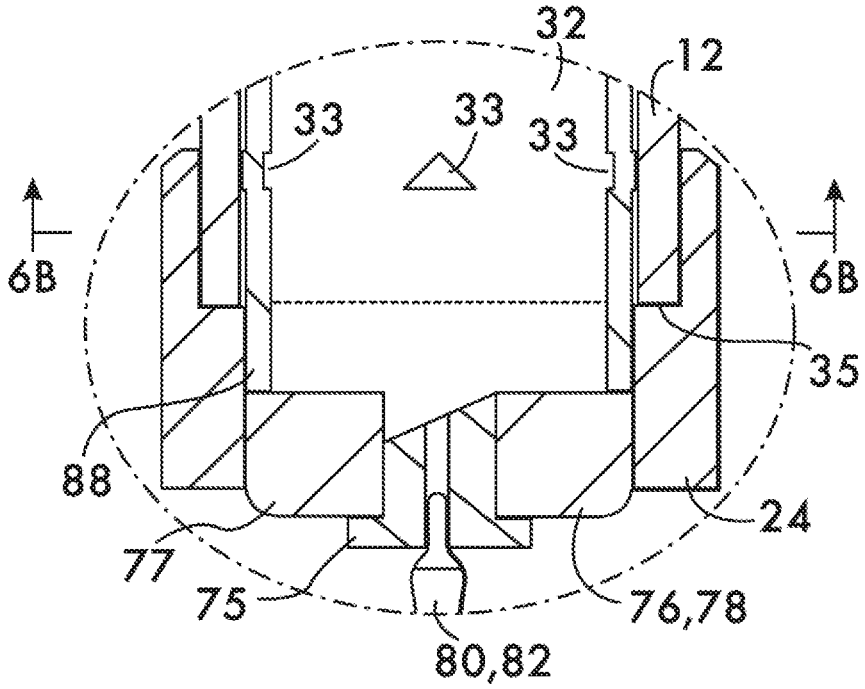
FIG. 6A is a longitudinal sectional view of a portion of the dry sprinkler assembly shown in FIG. 6 on an enlarged scale.

In operation the assembly 10 is attached to a branch line of a fire suppression system (not shown) using nipple 18, which may be threaded as shown or provided with a groove for use with mechanical couplings. Assembly 10 is initially in the "loaded" configuration shown in FIGS. 3 and 6, with the Bellville washer 64 in its closed position, facing and preloaded against the seat 52. As shown in FIGS. 6 and 6A, washer 64 is held in the closed, preloaded position by the second closing member 76 (plug 78) through engagement with tube 32, the plug engaging bore 26 of sprinkler 20. In turn, plug 78 is maintained in engagement with bore 26 by the temperature sensitive trigger 80, frangible vial 82 acting between the nose 31 and the trigger bearing 75 of plug 78.

Figure 6B:
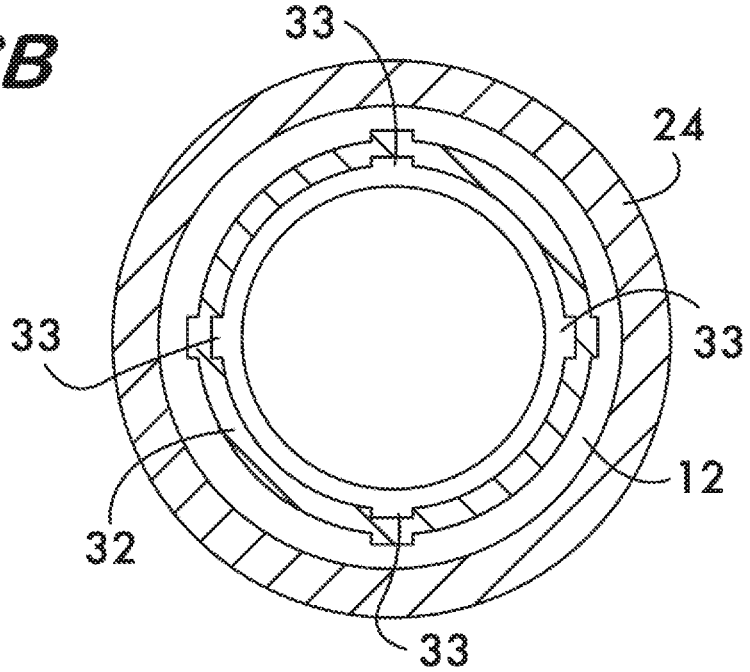
FIG. 6B is a cross sectional view taken at line 6B-6B of FIG. 6A.
Figure 7:
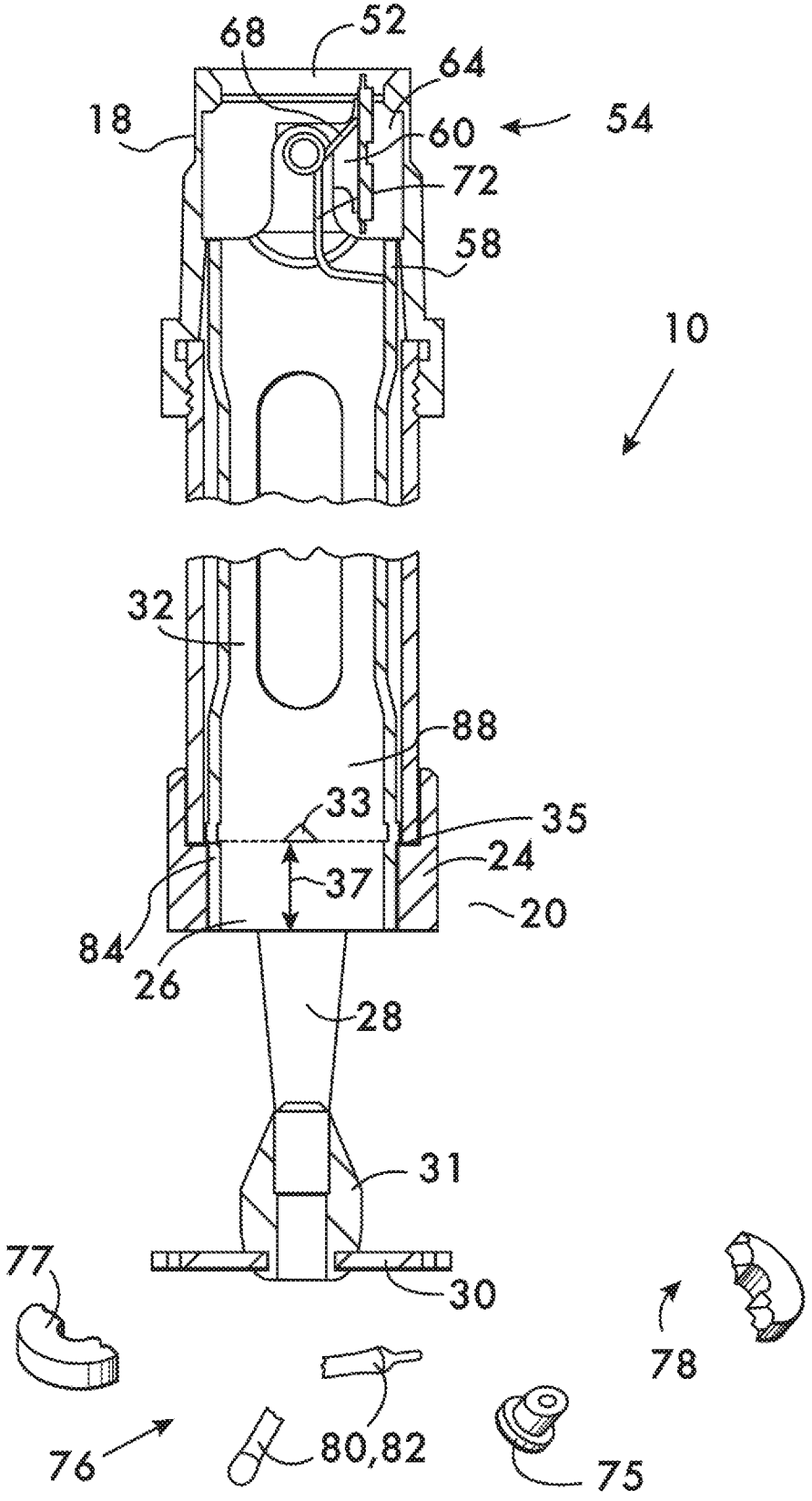
FIG. 7 is a longitudinal sectional view of the dry sprinkler assembly shown in FIG. 1 in a "triggered" state.

FIGS. 4 and 7 show the assembly 10 in the "triggered" configuration which permits fluid flow through the pipe element 12. This occurs when the ambient temperature surrounding trigger 80 reaches or exceeds a predetermined threshold (for example 155° F.) causing the thermal trigger, in this case, frangible vial 82 to shatter and thereby removing the support to plug 78. With no axial constraining force on tube 32 the Bellville washer 64 pushes against the seat 52, moving the tube 32 axially away from the seat. This movement is aided by biasing member 68 and the action of fluid pressure within the branch line acting upon first closing member 54. Motion of the tube 32 disengages the washer 64 from the seat 52 which permits the platform 60 bearing the washer to pivot on the pivot support 56 (biased by torsion spring 72, see FIG. 3) into the angularly oriented position shown in FIG. 4. The orientation angle 66 is set when the projection 74 extending from platform 60 engages the stop surface 70 on the pivot support 56. Motion of the tube 32 away from the seat 52 ejects the second closing member 76, the multi-piece construction of plug 78 aiding ejection of the plug from bore 26. For the sprinkler embodiment shown in FIG. 2A having female threads 27 within bore 26, the motion of tube 32 within pipe element 12 is limited by a plurality of detents 33 (see FIGS. 6A and 6B) which project outwardly from tube 32 and engage a shoulder 35 projecting into the bore 26 defined by the sprinkler body 24. Shoulder 35 in this example comprises an annulus and surrounds the bore 26. Detents 33 are conveniently formed by outward piercings of the tube 32 positioned at a distance 37 from the second end 84 of the tube (see FIG. 6) to permit the tube to move and allow rotation of the platform 60 as shown in FIG. 7. In a practical design there are four detents 33 angularly spaced at 90° intervals around the tube 32.

Figure 6C:
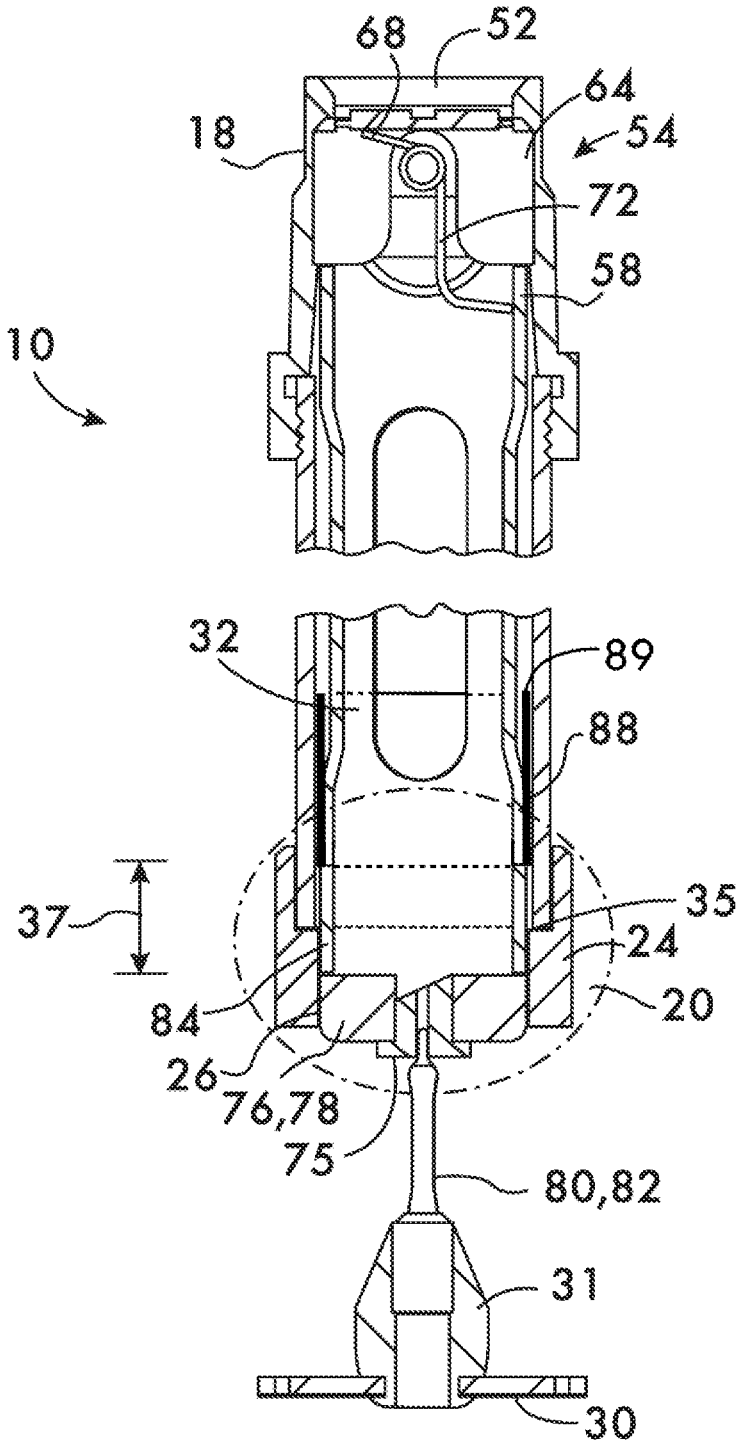
FIG. 6C is a longitudinal sectional view of another example embodiment of a dry sprinkler assembly in a "loaded" state.

FIG. 6C shows another example embodiment comprising a flow conditioning collar 89 which is attached to tube 32 proximate to its second end 84. As in the example embodiment shown collar 89 may overlie at least a portion of the openings 46 in the sidewall 44. Collar 89 performs two functions. In this configuration the collar 89 provides a flow conditioning surface which is expected to reduce turbulent flow through the tube 32 before it exits the tube and provides a stop which engages the shoulder 35 to limit the extent of travel of tube 32 when the sprinkler assembly is triggered.

Figure 8:
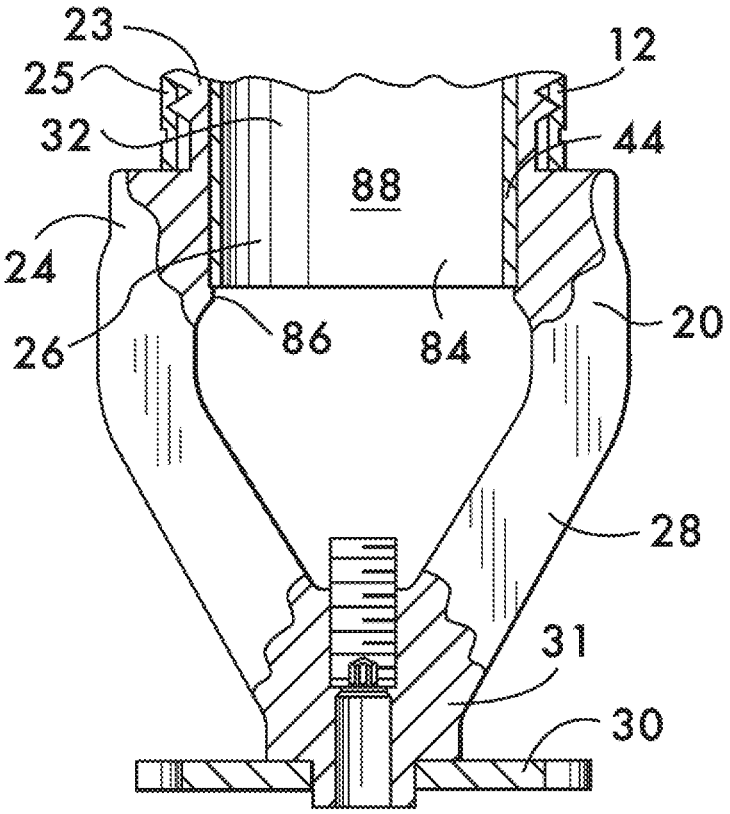
FIG. 8 is a longitudinal sectional view of a portion of an example embodiment of a dry sprinkler assembly according to the invention.

In another example embodiment, shown in FIG. 8, the longitudinal (sliding) motion of the tube 32 relative to the pipe element 12 is limited by engagement of the second end 84 of the tube with one or more stop surfaces 86 positioned in spaced relation to the second end 22 of the pipe element 12. In this example, two stop surfaces 86 are positioned on the arms 28 of sprinkler 20. For both sprinkler embodiments a portion of sidewall 44, located proximate to the second end 84 of tube 32, has no openings therethrough and acts as a flow conditioning conduit 88 when water or other fire suppressing liquid is discharged.

As shown in FIG. 7, with both the first closing member 54 in its open position and the second closing member 76 no longer engaged with bore 26, fire suppressing fluid (water, for example) may flow from the piping network through the pipe element 12 and tube 32 whereupon it exits the flow conditioning conduit 88 and impinges on the deflector 30 and is distributed over the fire event area.

Dry sprinkler assemblies according to the invention are expected to improve both the reliability and effectiveness of fire suppression systems while using 1 inch NPS pipe for the pipe element connecting the piping network in the warm environment to the sprinkler located in the cold environment. The discharge rate of dry sprinkler assemblies according to the invention is expected to be equal to or greater than a k factor of 11.2, wherein the k factor is defined as $k=q/\sqrt{p}$ where q is the discharge rate from the assembly 10 in gallons per minute and p is the pressure within the pipe element 12 in psi (gauge).

What is claimed is:

1. A dry sprinkler assembly for use with a piping network of a fire suppression system, said dry sprinkler assembly comprising:

a 1 inch NPS pipe element having a first end attachable in fluid communication with said piping network;

a valve positioned within said pipe element proximate to said first end, said valve having a first closing member movable between a closed position preventing fluid flow through said pipe element, and an open position permitting fluid flow through said pipe element, said valve comprising a seat mounted proximate to said first end of said pipe element, said first closing member being engageable with said seat;

a tube coaxially positioned within said pipe element, said tube having an outer perimeter smaller than an inner perimeter of said pipe element and being moveable lengthwise along said pipe element, said first closing member being mounted on a first end of said tube, said first closing member comprising:

a pivot support mounted on said first end of said tube, a platform being pivotably mounted on said pivot support;

an obturation body mounted on said platform, said obturation body being pivotable between a first position facing said seat and engageable therewith, and a second position angularly oriented relative to said seat;

a stop surface positioned on said pivot support;

a projection extending from said platform and engageable with said stop surface to limit pivoting motion of said platform; wherein a fire suppression sprinkler is mounted on a second end of said pipe element, said sprinkler defining a bore in fluid communication with said pipe element, said sprinkler further comprising:

a plug in engagement with said bore, a second end of said tube being engaged with said plug when said plug is in said engagement with said bore;

a temperature sensitive trigger engaged with said plug and maintaining said plug in said engagement until an ambient temperature exceeds a predetermined threshold, said trigger releasing said plug from said engagement with said bore when said ambient temperature reaches or exceeds said predetermined threshold; wherein when said first closing member is in said open position and said plug is released from said engagement, said sprinkler assembly achieves a discharge rate equal to or greater than a k factor of 11.2.

2. The dry sprinkler assembly according to claim 1, wherein said tube has a round cross section with an outer diameter smaller than an inner diameter of said pipe element.

3. The dry sprinkler assembly according to claim 1, wherein said tube comprises a sidewall defining a plurality of openings therethrough.

4. The dry sprinkler assembly according to claim 3, wherein said openings comprise a plurality of slots oriented lengthwise along said tube.

5. The dry sprinkler assembly according to claim 3, wherein a portion of said sidewall proximate to said second end of said tube has no openings therethrough.

6. The dry sprinkler according to claim 3, wherein said openings comprise at least 30% of a surface area of said sidewall.

7. The dry sprinkler assembly according to claim 1, wherein said obturation body comprises a Bellville washer.

8. The dry sprinkler assembly according to claim 1, further comprising a spring acting between said tube and said platform for biasing said obturation body into said second position.

9. The dry sprinkler assembly according to claim 1, wherein said sprinkler comprises:

a body defining said bore;

a pair of arms extending from said body away from said second end of said pipe element;

a deflector plate mounted on said arms, said trigger being positioned between said deflector plate and said plug.

10. The dry sprinkler assembly according to claim 9, wherein said trigger comprises a frangible vial filled with a heat sensitive liquid.

11. The dry sprinkler assembly according to claim 9, wherein said sprinkler comprises at least one stop surface engageable with said tube to limit sliding motion thereof relative to said pipe element.

12. The dry sprinkler assembly according to claim 11, wherein said stop surface comprises at least one projection extending from one of said arms.

13. The dry sprinkler assembly according to claim 12, wherein said sprinkler further comprises a nipple extending from said body, said nipple having male screw threads thereon.

14. The dry sprinkler assembly according to claim 11, wherein:

said sprinkler comprises a shoulder on said body, said shoulder projecting into said bore, said shoulder defining said at least one stop surface;

said tube comprises at least one detent projecting outwardly therefrom, said at least one detent being positioned in spaced relation from said second end of said tube and engageable with said at least one stop surface upon motion of said tube within said pipe element.

15. The dry sprinkler according to claim 14, wherein said shoulder comprises an annulus surrounding said bore.

16. The dry sprinkler according to claim 14, wherein said body comprises female threads surrounding said bore.

17. The dry sprinkler assembly according to claim 8, wherein said spring comprises a torsion spring.

18. The dry sprinkler assembly according to claim 1, wherein said plug comprises a plurality of plug bodies engageable with said bore, said plug bodies defining a gap permitting draining of condensate from said pipe element.

19. The dry sprinkler assembly according to claim 18, further comprising a trigger bearing engageable with said plurality of plug bodies and said trigger.

20. The dry sprinkler assembly according to claim 1, wherein said 1 inch NPS pipe element has a wall thickness less than 0.095 inches.

21. The dry sprinkler assembly according to claim 3, further comprising a flow conditioning collar attached to said tube proximate to said second end thereof, said collar overlying at least a portion of said plurality of openings in said sidewall of said tube.

22. The dry sprinkler assembly according to claim 1, wherein said sprinkler comprises:

a body defining said bore, said body comprising female threads surrounding said bore;

a pair of arms extending from said body away from said second end of said pipe element, said second end of said pipe element having male screw threads thereon engaging said female threads surrounding said bore;

a deflector plate mounted on said arms, said trigger being positioned between said deflector plate and said plug.

* * * * *